US005344046A

United States Patent [19]

Maldanis et al.

[11] Patent Number: 5,344,046

[45] Date of Patent: Sep. 6, 1994

[54] UNIVERSAL PULL-OUT DRAWER FOR VENDING MACHINE

[75] Inventors: Algert J. Maldanis, Heath, Tex.; Walter L. Koch, Ormond Beach, Fla.; David K. Giegerich, Fair Lawn; Andris C. Sloss, Sussex, both of N.J.

[73] Assignee: C-Power Companies, Inc., Rockwall, Tex.

[21] Appl. No.: 71,720

[22] Filed: Jun. 3, 1993

[51] Int. Cl.[5] ..... B67D 5/10

[52] U.S. Cl. ..... 222/2; 221/98; 221/99

[58] Field of Search ..... 222/2, 129.1-129.4; 221/2, 97-99, 129; 364/479

[56] References Cited

U.S. PATENT DOCUMENTS

| | | | |
|---|---|---|---|
| 1,592,069 | 7/1926 | Benson | 198/798 |
| 2,493,857 | 1/1950 | Cargill | 198/138 |
| 2,512,356 | 6/1950 | Massiello | 198/138 |
| 2,965,214 | 12/1960 | Schlumpf et al. | 198/25 |
| 3,021,685 | 2/1962 | Gore et al. | 222/2 |
| 3,184,105 | 5/1965 | Willoughby et al. | 221/129 |
| 3,202,265 | 8/1965 | Anders | 198/158 |
| 3,297,378 | 1/1967 | Krug et al. | 312/223 |
| 3,762,601 | 10/1973 | McLaughlin | 221/2 |
| 3,902,950 | 9/1975 | Raynor et al. | 198/158 |
| 4,730,750 | 3/1988 | Ficken | 221/129 |
| 4,834,231 | 5/1989 | Awane et al. | 221/2 |
| 4,942,290 | 7/1990 | Frerking | 235/381 |
| 4,962,866 | 10/1990 | Phillips | 364/479 |
| 4,967,896 | 11/1990 | Hara | 221/2 |
| 5,222,624 | 6/1993 | Burr | 221/129 |

OTHER PUBLICATIONS

Brochure of Rowe International, Inc. "Genesis TM. The Look of the Future from Rowe ®".

*Primary Examiner*—Andres Kashnikow
*Assistant Examiner*—Philippe Derakshani
*Attorney, Agent, or Firm*—John W. Montgomery

[57] ABSTRACT

A control panel drawer for a consumer-operated vending machine of a type having a cabinet defining an internal volume in which vendable products are held for selectable vending, a front display at which vendable products are designated with price and selection indicia and a money acceptance and product selection panel at which an amount of money corresponding to the price of a desired product selection and instructions for dispensing the desired product selection are entered by the consumer and an operatively associated vending mechanism connected through an electronic circuit to vend the selected product to the consumer in response to insertion of money and instructions from a consumer to the control panel drawer includes a drawer which is slidably connected to the vending machine cabinet having a first position at which the drawer is inserted within the vending machine cabinet adjacent to the internal product holding volume and a second position slidably extended forward of the front display. The selection panel is attached to a front surface of the drawer which is substantially parallel to the product front display when the drawer is in the first position. The electronic circuit board is attached to the drawer and movable therewith, so that it is enclosed within the cabinet when the drawer is in the first position and so that it is accessibly exposed when the drawer is in the second position. Flexible connectors extend between the electronic circuit board and the vending mechanism so that the drawer is slidable between the first and the second positions without disconnecting the electronic circuit board from the vending mechanism.

20 Claims, 2 Drawing Sheets

UNIVERSAL PULL-OUT DRAWER FOR VENDING MACHINE

TECHNICAL FIELD OF THE INVENTION

The present invention relates to a consumer-operated vending machine capable of dispensing a variety of products at various prices, of the type having cabinets enclosing the products and electromechanical control of product selection and vending.

BACKGROUND OF THE INVENTION

Modern consumer-operated vending machines are increasingly being controlled with electronic control panels for operating electromechanical dispensing mechanisms. In recent years, vending machines have been constructed for an increasing variety of products, such as frozen foods, cold drinks, coffee, prepared food, packaged candy and snack foods, and others, many of which require special product handling. The resulting variety of specialized handling of the product, such as vertical movement, horizontal movement, refrigeration, component mixing, heating, and similar handling functions must be controlled within the vending machine.

Typically, the vending machines have been constructed, each specifically for a particular type of product or a particular vending operation, whether it be maintaining frozen products such as ice cream, dispensing refrigerated products, such as cold drinks, sandwiches, fruit, or other perishable foods, or mixing, heating or cooling liquid products, such as soups, coffee or carbonated drinks. In many cases, the basic functions and control signal connections can be set during manufacture, such as preset refrigeration temperatures, preset vending actuation sequences, preset heating temperatures, preset mixing sequences, and the like. But, this is not always the case as product requirements or requirements due to a machine's operating environment sometimes require adjustments. Also, almost without exception, the product or its cost changes periodically. The price at which a product is to be vended must be correspondingly changed by the owner of the vending machine or the concessionaire, depending on the price change or product change. Typically, vending machines have been constructed with a hinged and locked door through which the interior of the cabinet can be accessed for both product filling or replacement, and also for access to the internal control by which price changes could be effected. Hingeable doors providing adequate access both for filling the machine and also for accessing the control mechanism may require side clearance which can be at a premium in compact vending areas or in areas where a large number of vending machines are provided. Because of the individual nature of construction for vending machines for various products, the organization, arrangement, and operation of each vending machine is different for each machine. Machine differences may require additional training and may produce inefficiency for concessionaires who may have more than one type of product and corresponding individualized vending machines for the separate product types. Also, the design and manufacturing costs of separate vending machines for each separate product type can be substantial.

SUMMARY OF THE INVENTION

These and other drawbacks of the previously existing machines have been overcome by providing a control panel drawer for consumer-operated vending machines, which control panel drawer has a substantial similar configuration for use on a variety of vending machines with a variety of product types and corresponding variety of handling operations. The control panel drawer is substantially universal in its adaptability for vending machines of the type having a cabinet defining an internal volume in which vendable products are held for selectable vending, a front display in which the vendable products are designated with price and selection indicia, and a money acceptance device by which an amount of money is received corresponding to the designated price of the product and a product selection panel by which instructions for dispensing the desired product are entered by the consumer. Each vending machine will have an operatively associated vending mechanism connected through electronic circuitry to respond to the insertion of money and the instructions from the consumer. The control panel drawer is slidably connected to the vending machine cabinet so that it has a first position in which the drawer is closed and its interior is enclosed within the vending machine cabinet and a second position in which the drawer is extended forward of the front display and its interior is accessible. In its first position, the drawer is adjacent to one side of the internal product holding volume and does not require any particular configuration or vending mechanism. The product selection panel is attached to the front surface of the drawer so that it is substantially aligned with the front display of the vending machine when the drawer is closed in its first position. An electronic circuit board is attached in the interior of the drawer behind the product selection panel and is movable therewith so that it is enclosed within the cabinet with the drawer in the first position and it is accessibly exposed with the drawer in the second position. Flexible electrical connectors extend between the electronic circuit board and the vending mechanism so that the drawer is slidable between the first and second positions without damaging or disconnecting the flexible electrical connectors.

According to another feature of the invention, the control panel drawer includes on its electronic circuit board one or more standardized circuit board portions for price selection and for producing vending instructions in response to consumer operation of the money acceptance device and product selection panel. There is also the replaceable circuit portion which may be in the form of a programmable computer chip, such as an E-prom, by which the standardized control circuit can be selectably modified for controlling specific vending mechanisms, such as timed motor activation or solenoid actuation, and specific environmental controls, such as heating, cooling or product mixing controls. According to this feature, the control panel drawer becomes simply and conveniently adaptable for use in vending machines for a diverse variety of products to be vended.

According to yet another feature of the invention, the control panel drawer is provided with a keyboard for programming the circuit board, such as for setting a price or entering a price change. The keyboard has a first position at which it is enclosed within the interior of the pull-out drawer and a second position at which the keyboard is conveniently extended outside of the interior area of the drawer. The keyboard is placed in its first position for closing the drawer. The keyboard is moved to its second position for programming when the drawer is in its open position. This permits the concessionaire to operate the keyboard from the front of the machine with a clear view of the front display of products and also of the product selection panel.

BRIEF DESCRIPTION OF THE DRAWINGS

These and other objects and advantages will be more fully understood with reference to the specifications, claims and drawings below in which like numerals represent like elements and in which:

DETAILED DESCRIPTION OF THE PREFERRED EMBODIMENT

Figure 1:
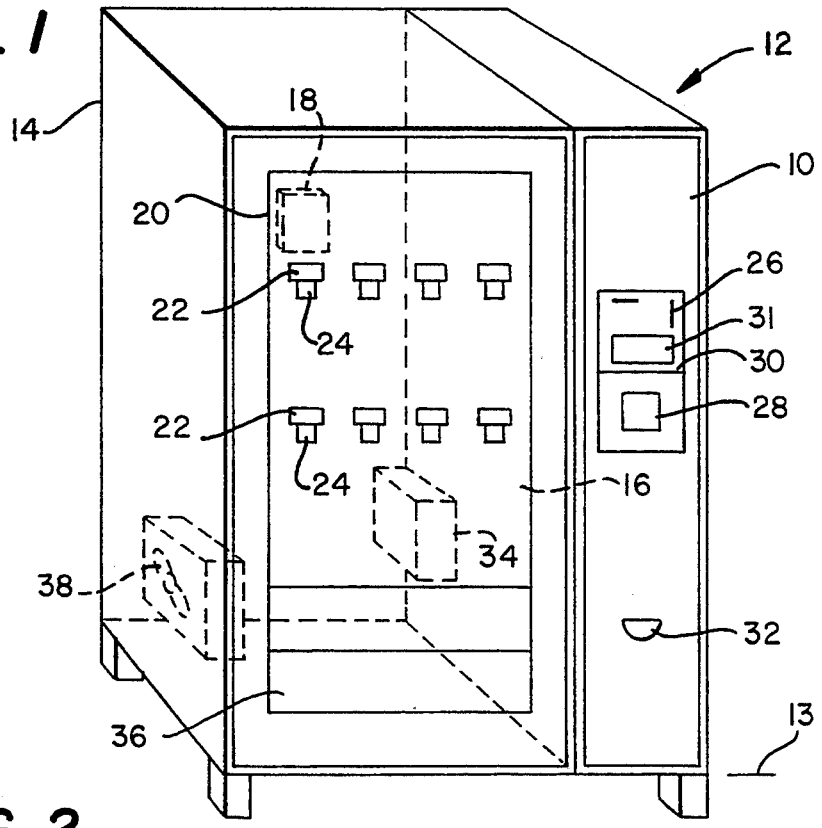
FIG. 1 is a front perspective view of a consumer-operated vending machine having a control panel drawer in a closed position according to the present invention.

FIG. 1 depicts a front perspective schematic view of a control panel drawer 10 attached to a vending machine 12 according to the present invention. The control panel drawer 10 shown in a first position 13 in which drawer 10 is closed and its interior 11 (shown in FIG. 2) is enclosed within vending machine cabinet 14. The control panel drawer 10 in its closed position 13 is adjacent to an internal volume 16 in which vendable products 18 are held pending selection, payment, and dispensing from the vending machine.

A front display panel 20 is presented with a price designation 22 and corresponding product selection indicia 24. The front display panel 20 may, for example, be graphical or photographical presentations of the product or a depiction of the exterior packaging of the product. Preferably, the front display panel 20 comprises a window 25 through which the products 18 may be viewed by the consumer. This enhances the versatility of the vending machine which is advantageously beneficial with a universally adaptable control panel drawer.

The control panel drawer has affixed thereto a money acceptance mechanism 26, such as a dollar bill receiving slot, a coin receiving slot, or both. A product selection panel 28 is also included and both money receiving device 26 and selection panel 28 may be conveniently included on an operator instruction input panel 30 by which product selections, according to the selection indicia 24, for a desired product can be input, as by pressing a designated key, button, or switch, or a sequence of such switches, by which the selection indicia is produced as an input signal. The input panel 30 may also advantageously include a readout display 31 by which the amount of money deposited, "sold out" information, or other information may be presented to the user. Readout display 31 is preferably a vacuum fluorescent display but may also be a standard LCD or LED display. The control panel drawer further has an exposed change return opening 32 by which overpayment or credit amounts can be returned to the consumer after a selection has been made.

Schematically depicted in hidden lines, within the cabinet 14 and in the internal volume 16 at which the products 18 are being held, is a vending mechanism 34 which upon receiving an appropriate signal from the control panel acts in an appropriate manner to move the product to the dispensing area 36. The operation of the vending mechanism 34, as well as the orientation and structure of the dispensing area 36 is dependent upon the type or variety of product being dispensed. The particular configuration and form shown schematically in FIG. 1 is demonstrative only. Also shown schematically in FIG. 1 is an environmental control unit 38 such as a refrigeration unit. As both the vend mechanisms and the environmental control devices are within the interior volume 16 and as the control panel drawer is adjacent to the interior volume 16, the drawer is advantageously useful with a large variety of vending machines.

Placing control panel drawer 10 in the closed position 13 also places the front operator input panel 30 substantially adjacent to and aligned with the front display panel 20 as indicated at 13.

Figure 2:
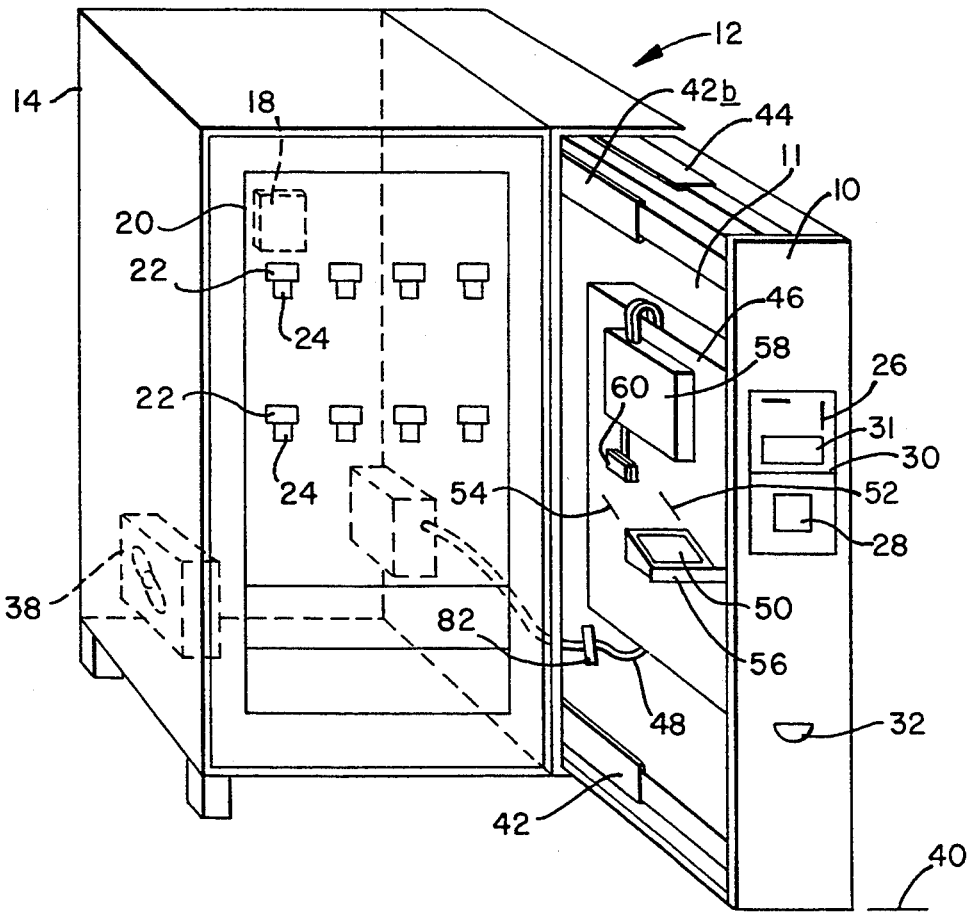
FIG. 2 is a front perspective view of a consumer-operated vending machine of FIG. 1 with an inventive control panel drawer in an open position according to the present invention.

FIG. 2 depicts a perspective front view of the consumer-operated vending machine 12 of FIG. 1 having the control panel drawer 10 extended outwardly from front display panel 20 to a second position 40 at which there is access to the interior 11 of the control panel drawer 10. Advantageously, drawer 10 slides forward of the front display panel 20 without up and down movement and without side-to-side movement. It is continuously supported from vending machine 12 as it moves between the first and second positions.

The drawer 10 is preferably mounted to the cabinet 14 through a slide mechanism 42. In order to accommodate the weight of door 10 without any up and down movement, a slide mechanism 42 preferably comprises a vertically rigid slide mechanism 43 consisting of at least an upper slide **43*a* and a lower slide 43*b*. Also, in order to maintain the drawer in side-to-side alignment for reinsertion into the cabinet 14, a horizontally rigid slide 44 connects the drawer so that it is movable outward from the first closed position 13 to the second open position 40**.

Inside of the drawer 10 is a circuit board 46 which is interconnected with the vending mechanism 34 of the vending machine 12 through flexible electrical connector 48. If the environmental control device 38 is present, it is also interconnected to the circuit board 46. Other types of devices, such as mixing apparatus or heating apparatus, may also interconnect with circuit board 46 through connector 48. It has been found that a plurality of sufficiently long insulated electrical wires, preferably of the type having multiple wire filaments braided within an insulative material can be used to provide the flexible electrical connector 48. The number of wires which make up flexible electrical connector 48 is selected as a number sufficient for the types of vending mechanisms, environmental control mechanisms, or other devices for which the circuit board 46 is intended to be adaptable.

Also advantageously provided within the interior of drawer 10 is a keyboard panel 50 for programmable input, which keyboard panel 50 can be accessed when the drawer 10 is moved from the closed position 13 to the open position 40. Preferably, access is obtained by providing keyboard panel 50 with a first held position 52 in which the keyboard panel 50 is enclosed within the drawer 10 and a second position 54 at which the keyboard panel 50 is extended out of the interior 11 of drawer 10. In the extended position 54, the programmable keyboard panel 50 can be easily accessed by an operator from a position in front of the vending machine 12. Advantageously, a slide mechanism 56 is provided which facilitates easy movement between the first and the second position and further provides mechanical support for input as through a manually actuated keyboard panel 50.

Attached to circuit board 46 are component circuits 58 in which circuitry is provided for generating control signals for the vending mechanism and for any internal environmental control or other control mechanisms of a vending machine. The component circuits 58 operate in cooperation with one or more changeable plug-in circuits 60, such as selected E-prom devices 60 by which the operation of the circuit board 46 and its component circuits 58 can be selectably modified for a large variety of vending machine functions. While the entire circuit board 46 may be replaceable for repair purposes, and also component circuits 58 may be detachable for repair purposes, the basic design of the circuit board and the major components 58 may be maintained substantially the same for various vending machine functions. The specific functions can be easily modified with the insertion of an appropriately pre-programmed plug-in E-prom type device or electrically programmable devices, such as EE-ROMS. This feature advantageously gives the control panel drawer 10 of this configuration substantially universal adaptability to a variety of vending machines without requiring redesign and remanufacture. In this manner, the same pull-out drawer 10 with the same circuit board 46 and appropriate component circuits 58 can be used in a vending machine of a completely different function by merely selectably changing the E-prom for appropriate pre-program operating parameters. Appropriate operating signals and appropriate responses to the consumer input panel 30, as well as appropriate responses to the concessionaire's program input keyboard panel 50 are governed by the variables of the E-prom.

Figure 3:
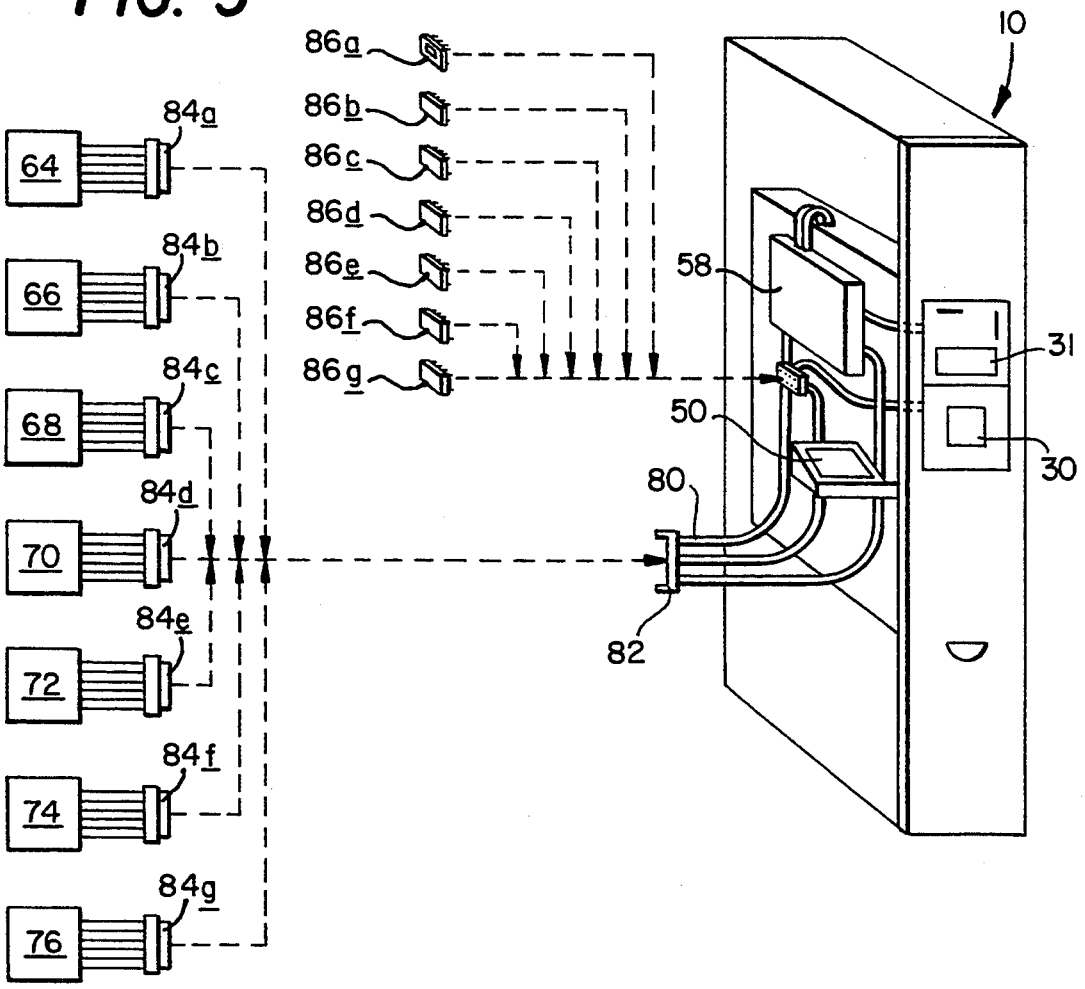
FIG. 3 is a schematic depiction of a control panel drawer according to the present invention in which multiple vending machine operating mechanisms and plug-in component circuits are depicted in block diagrammatic form demonstrating interchangeable interconnection with the control panel drawer which is conveniently adaptable for use therewith, according to the present invention.

The advantageous interchangeability of control panel drawer 10, according to the present invention, is schematically represented in FIG. 3, in which examples of a variety of functions for vending machines is represented in a block format. The drawer 10 may be installed in a vending machine with one or more of the indicated functions. For example, a refrigeration mechanism 64 may be connected through a flexible electrical connector which may include a wiring harness 80. A plug-in connector **84*a* is attached to a receptacle 82 on the wiring harness 80. Similarly, a heating mechanism 66, a fluid mixing mechanism 68, a cold drink dispensing mechanism 70, a candy dispensing mechanism 72, a perishable food dispenser mechanism 74, a product cooking apparatus 76, or any of a variety of controls or combination of controls and mechanisms for vending machine operation may be plugged into receptacle 82 through corresponding plug-in connectors 84*b*, 84*c*, 84*d*, 84*e*, 84*f*, or 84*g*, respectively. In each instance where the control panel drawer is attached to a separately functioning vending machine mechanism 64, 66, 68, 70, 74, 76, or 78, an appropriate E-prom 86*a–g* is correspondingly plugged into a receptacle 88. The E-prom is thereby appropriately interconnected as needed for proper operation, with replaceable component circuits 58, with programmable input keyboard panel 50, as well as with input from consumer input panel 30**.

Thus, what has been disclosed is a universal control panel pull-out drawer which is usable on a variety of vending machines and conveniently slides out for access to its interior for changing component parts and for concessionaire reprogramming of the prices, the product selections, and the like. The drawer preferably slides straight forward of the vending machine so that spatial requirements to either side are minimized, it being understood that the front of vending machines is typically maintained with sufficient clearance for a consumer so that no additional clearance would be required to either side of the vending machine for access into the control panel drawer.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A control panel drawer for a consumer-operated vending machine of a type having a cabinet defining an internal volume in which vendable products are held for selectable vending, a front display at which vendable products are designated with price and selection indicia and a money acceptance and product selection panel at which an amount of money corresponding to the price of a desired product selection and instructions for dispensing the desired product selection are entered by the consumer and an operatively associated vending mechanism connected through an electronic circuit to respond to said insertion of money and instructions by vending the selected product to the consumer, said control panel drawer comprising:

(a) a drawer slidably connected to said vending machine cabinet having a first position enclosed within said vending machine cabinet adjacent to said internal product holding volume and a second position slidably extended forward of the front display;

(b) said selection panel attached to a front surface of said drawer which is substantially parallel to said product front display with said drawer in said first position; and (c) said electronic circuit comprises a circuit board attached to said drawer and movable therewith, so that it is enclosed within said cabinet with said drawer in said first position and accessibly exposed with said drawer in said second position; and (d) flexible connectors between said electronic circuit board and said vending mechanism so that said drawer is slidable between said first and second positions without disconnecting said electronic circuit board from said vending mechanism.

2. A control panel drawer for a consumer-operated vending machine is in claim 1 further comprising:

(a) vertically rigid slide mechanism slidably connecting said drawer to said vending machine cabinet; and (b) horizontally rigid slide mechanism slidably connecting said drawer to said vending machine cabinet.

3. A control panel drawer for a consumer-operated vending machine as in claim 1 wherein said drawer slidably connected to said vending machine cabinet has a construction in which it is a narrow drawer vertically from a top of said cabinet to a bottom of said cabinet and it is positioned at one side of said cabinet, such that slidable insertion into said cabinet avoids interfering with the product-holding volume of said cabinet extending from said top to near said bottom of said cabinet.

4. A control panel drawer for a consumer-operated vending machine as in claim 1 wherein said drawer slidably connected to said vending machine cabinet is slidably extendable forward of said front display of said vending machine independent of opening said product holding volume of said cabinet.

5. A control panel drawer for a consumer-operated vending machine as in claim 1 wherein said electronic circuit board attached to said drawer comprises:

(a) a plug-in connector for a pre-programmed circuit such as an E-prom; and (b) a selectably insertable E-prom engaged within said plug-in receptacle for selectably choosing a variety of vending machine control functions.

6. A control panel drawer for a consumer-operated vending machine as in claim 5 in which said selected E-prom provides said control by said electronic circuit board of said control panel with instructions for refrigeration within said vending machine.

7. A control panel drawer for a consumer-operated vending machine as in claim 5 in which said E-prom is selected to provide said electronic circuit board with cold drink dispensing control features.

8. A control panel drawer for a consumer-operated vending machine as in claim 5 wherein said selected E-prom provides an electronic circuit board with control capabilities for a vending machine of the type having movable horizontal product holding shelves.

9. A control panel drawer for a consumer-operated vending machine as in claim 5 wherein said selected E-prom provides the vending machine with packaged snack food dispensing capabilities.

10. A control panel drawer for a consumer-operated vending machine as in claim 5 wherein said selected E-prom provides the vending machine with product heating capabilities.

11. A control panel drawer for a consumer-operated vending machine as in claim 5 wherein said selected E-prom provides the vending machine with fluid product mixing capabilities.

12. A control panel drawer for a consumer-operated vending machine as in claim 1 wherein said electronic circuit board attached to said drawer comprises:

(a) a plug-in connector for a pre-programmed circuit such as an EE-ROM; and (b) a selectably insertable EE-ROM engaged within said plug-in receptacle for selectably choosing a variety of vending machine control functions.

13. A control panel drawer for a consumer-operated vending machine as in claim 12 in which said selected EE-ROM provides said control by said electronic circuit board of said control panel with instructions for refrigeration within said vending machine.

14. A control panel drawer for a consumer-operated vending machine as in claim 12 in which said EE-ROM is selected to provide said electronic circuit board with cold drink dispensing control features.

15. A control panel drawer for a consumer-operated vending machine as in claim 12 wherein said selected EE-ROM provides an electronic circuit board with control capabilities for a vending machine of the type having movable horizontal product holding shelves.

16. A control panel drawer for a consumer-operated vending machine as in claim 12 wherein said selected EE-ROM provides the vending machine with packaged snack food dispensing capabilities.

17. A control panel drawer for a consumer-operated vending machine as in claim 12 wherein said selected EE-ROM provides the vending machine with product heating capabilities.

18. A control panel drawer for a consumer-operated vending machine as in claim 12 wherein said selected EE-ROM provides the vending machine with fluid product mixing capabilities.

19. A control panel drawer for a consumer-operated vending machine as in claim 1 further comprising a keyboard panel attached within said slidably connected drawer operatively connected for programming various changeable vending parameters, such as price, and which keyboard panel is accessible for manual input with said slidably connected drawer in said second position extended forward of said front display.

20. A control panel drawer as in claim 19 wherein said keyboard panel is slidably attached to said drawer for easy movement between one position enclosed within said drawer and another position extended out of said drawer so that it can be easily accessed for manual input.

* * * * *